US006580261B1

(12) United States Patent
Dow

(10) Patent No.: US 6,580,261 B1
(45) Date of Patent: Jun. 17, 2003

(54) LOW CURRENT OPEN LOOP VOLTAGE REGULATOR MONITOR

(75) Inventor: Ronald Neal Dow, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/142,082

(22) Filed: May 8, 2002

(51) Int. Cl.[7] ..... G05F 3/16; G05F 3/20

(52) U.S. Cl. ..... 323/315; 323/314

(58) Field of Search ..... 323/314, 315, 323/316

(56) References Cited

U.S. PATENT DOCUMENTS 5,359,552 A * 10/1994 Dhong et al. ..... 365/189.09
6,046,577 A * 4/2000 Rincon-Mora et al. ..... 323/282
6,084,388 A * 7/2000 Toosky ..... 323/313

* cited by examiner

*Primary Examiner*—Bao Q. Vu
(74) *Attorney, Agent, or Firm*—Wagner, Murabito & Hao LLP

(57) ABSTRACT

A low current open loop voltage regulator monitor. A circuit is formed with a PTAT current source across a resistor. This current is mirrored by a circuit with two outputs. A first output is formed by a high output impedance current source that has a cascode output. A second output is formed by a higher voltage output current source that has a lower output impedance. The second output feeds an emitter of a PNP device that has its base coupled to the output of the first current source. The output of the first current source and the base of the PNP device are biased above ground by a series of diode and resistor drops that are of the same type comprising the PTAT circuit. This series of devices forms a stack of bandgap voltages that is nominally equal to, but independent of, the regulator output voltage. The emitter of the PNP device is coupled to the base of a transistor whose emitter is coupled to the regulated output, forming a "super charge" circuit that biases the regulator in response to a sudden increase in load current. In this novel manner, a regulated voltage supply may be independently monitored, and a supercharge or boost current source may be switched in to support the voltage supply under high load situations, providing faster and better response to load variations than is characteristic for regulated supplies under the prior art.

14 Claims, 2 Drawing Sheets

LOW CURRENT OPEN LOOP VOLTAGE REGULATOR MONITOR

TECHNICAL FIELD

Embodiments of the present invention relate to power supplies and voltage regulation. More particularly, embodiments of the present invention provide a low current open loop voltage regulator monitor.

BACKGROUND ART

Voltage regulators as a part of direct current power supplies are a ubiquitous, if often unseen part of modern life. Almost all electronic devices contain a regulated power supply. Semiconductor devices generally operate at a relatively low direct current voltage, for example 5 volts. Much of the electrical energy to power electronic devices is made available at different voltages. For example, mains power in the United States is nominally 120 volts AC. Automotive power is nominally 12 or 24 volts DC, but is subject to high voltage transients, for example 60 volts, during engine start and other conditions of changing loads.

Power supplies are generally employed to match the requirements of electronic devices (and other types of machines) to the available conditions of electrical power. Many devices, for example hand held electronics, powered by batteries nominally within the voltage range of the electronics employ power supplies to compensate for non-linear discharge characteristics of batteries and to extract as much energy from the batteries as possible.

An important part of most power supplies is a voltage regulator. Voltage regulators function to maintain voltage (and/or current) within a range of output values, for example five volts plus or minus three percent (5 v+/−3%). It is generally important to maintain an output voltage within the specified range. Too high a voltage may damage semiconductor devices, leading to decreased reliability or outright failure. If the voltage goes too low, voltage compliance is lost on many components which may lead to several types of failure. In addition, changes in power supply voltage may induce noise into subsequent processing stages of a circuit, diminishing performance or causing errors. A common, undesirable circumstance of suddenly adding a large load to a power supply, for example "turning on" a car radio, may "pull" the output voltage of a power supply "down," or out of tolerance. Frequently, power supplies are specifically designed to accommodate a range of such events.

In many voltage regulators, there is a discharge circuit that examines the output voltage to determine if a sudden current pulse will pull the output voltage out of regulation, or beyond the output voltage tolerance limit. Responsive to detecting such an event, additional circuitry may add boost or "super charge" energy to maintain output voltage within acceptable limits. For a variety of reasons, main regulator circuits typically are not able to respond quickly to large transient loads. Additional discharge detection and boost circuitry is generally necessary to overcome limitations in the feedback response of the main regulator circuits.

Discharge circuits may be comprised of a transistor whose emitter is coupled to the output voltage and a base that is coupled to a voltage that is the same as the regulator voltage, but independent of the regulator voltage. It is desirable for these two voltages to always be within a fraction of a $V_{BE}$ (base-emitter voltage) of one another. In this arrangement, the collector of the transistor is coupled to a fast charging circuit that acts independently of the regulator circuit to increase the output voltage.

FIG. 1 shows a prior art discharge circuit as described above that functions as a part of a 5 volt regulator. A zener diode voltage drop across transistor 11 is coupled to the base of transistor 12. The emitter of transistor 12 is coupled to a total of 9 M ohms (resistor 1 and 2) of resistance, further coupled to the diode stack formed by transistor 13 and transistor 14 to ground. The collector of transistor 12 is coupled to the PNP current mirror formed by transistor 15 which gives transistor 11 bias current. The center tap of the resistor pair is coupled to the base of transistor 16. Generally, the collector of transistor 16 is coupled to a fast charging circuit that acts independently of a regulator circuit to increase the output voltage. A voltage difference of a few hundred mV between the base and emitter of transistor 16 will conduct current from a fast charging circuit to support output voltage Vout 20.

If resistors 1 and 2 are of equal value, e.g., approximately 4.5 M ohms each, the voltage on the tap point is approximately 3.9 volts at 50 degrees C., and the tap voltage has a temperature coefficient (T.C.—a measure of how the voltage varies with respect to changes in temperature) of +128 ppm/degree C. when fabricated in a standard bi-polar semiconductor process. If the tap resistors are offset in value, for example resistor 2 is approximately 6 M ohms and resistor 1 is approximately 3 M ohms, the tap voltage is about 4.8 volts at 50 degrees C., and has a T.C. of about +414 ppm/degree C. for the same semiconductor process.

Unfortunately, this prior art design is limited to regulating voltages from about 2.8 volts to about 6 volts. At these voltage extremes, however, the temperature coefficient increases to unacceptable levels. In general, lower temperature coefficients are more desirable.

A further undesirable characteristic of this prior art design is the requirement for about 9 M ohms of resistance. In semiconductor design, this is a very large amount of resistance, requiring a great amount of die area to implement and driving up the cost of products containing this design. Further, newer semiconductor processes are less well suited to making resistances, especially resistances of this scale. For example, a newer semiconductor process may require approximately two to three times as much area to produce the same resistance as prior processes. Such a difference in process renders the prior art design commercially infeasible to produce.

Therefore, a low current open loop voltage regulator monitor with low temperature coefficients and utilizing smaller resistance values is highly desirable.

DISCLOSURE OF THE INVENTION

A low current open loop voltage regulator monitor is disclosed. A circuit is formed with a PTAT current source across a resistor. This current is mirrored by a circuit with two outputs. A first output is formed by a high output impedance current source that has a cascode output. A second output is formed by a higher voltage output current source that has a lower output impedance. The second output feeds an emitter of a PNP device that has its base coupled to the output of the first current source. The output of the first current source and the base of the PNP device are biased above ground by a series of diode and resistor drops that are of the same type comprising the PTAT circuit. This series of devices forms a stack of bandgap voltages that is nominally equal to, but independent of, the regulator output voltage. The emitter of the PNP device is coupled to the base of a transistor whose emitter is coupled to the regulated output, forming a "super charge" circuit that biases the regulator in response to a sudden increase in load current.

BEST MODE FOR CARRYING OUT THE INVENTION

In the following detailed description of the present invention, a low current open loop voltage regulator monitor, numerous specific details are set forth in order to provide a thorough understanding of the present invention. However, it will be recognized by one skilled in the art that the present invention may be practiced without these specific details or with equivalents thereof. In other instances, well-known methods, procedures, components, and circuits have not been described in detail so as not to unnecessarily obscure aspects of the present invention.

A LOW CURRENT OPEN LOOP VOLTAGE REGULATOR MONITOR

Embodiments of the present invention are described in the context of integrated circuit power supplies. However, it is appreciated that embodiments of the present invention may be utilized in other areas of electronic design.

Figure 1:
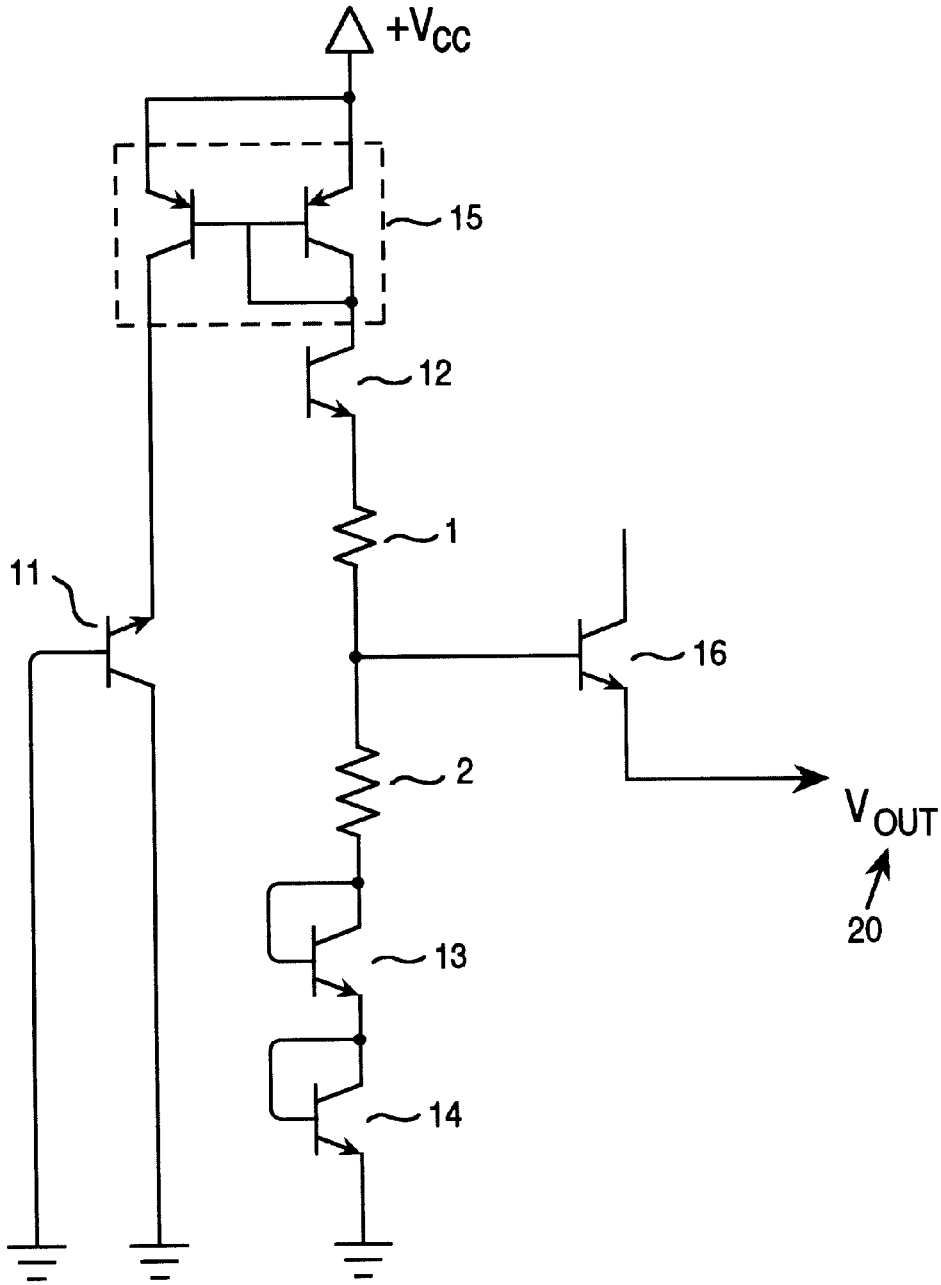
Figure 1 (Prior Art)
FIG. 1 shows a prior art discharge circuit that functions as a part of a 5 volt regulator.
Figure 2:
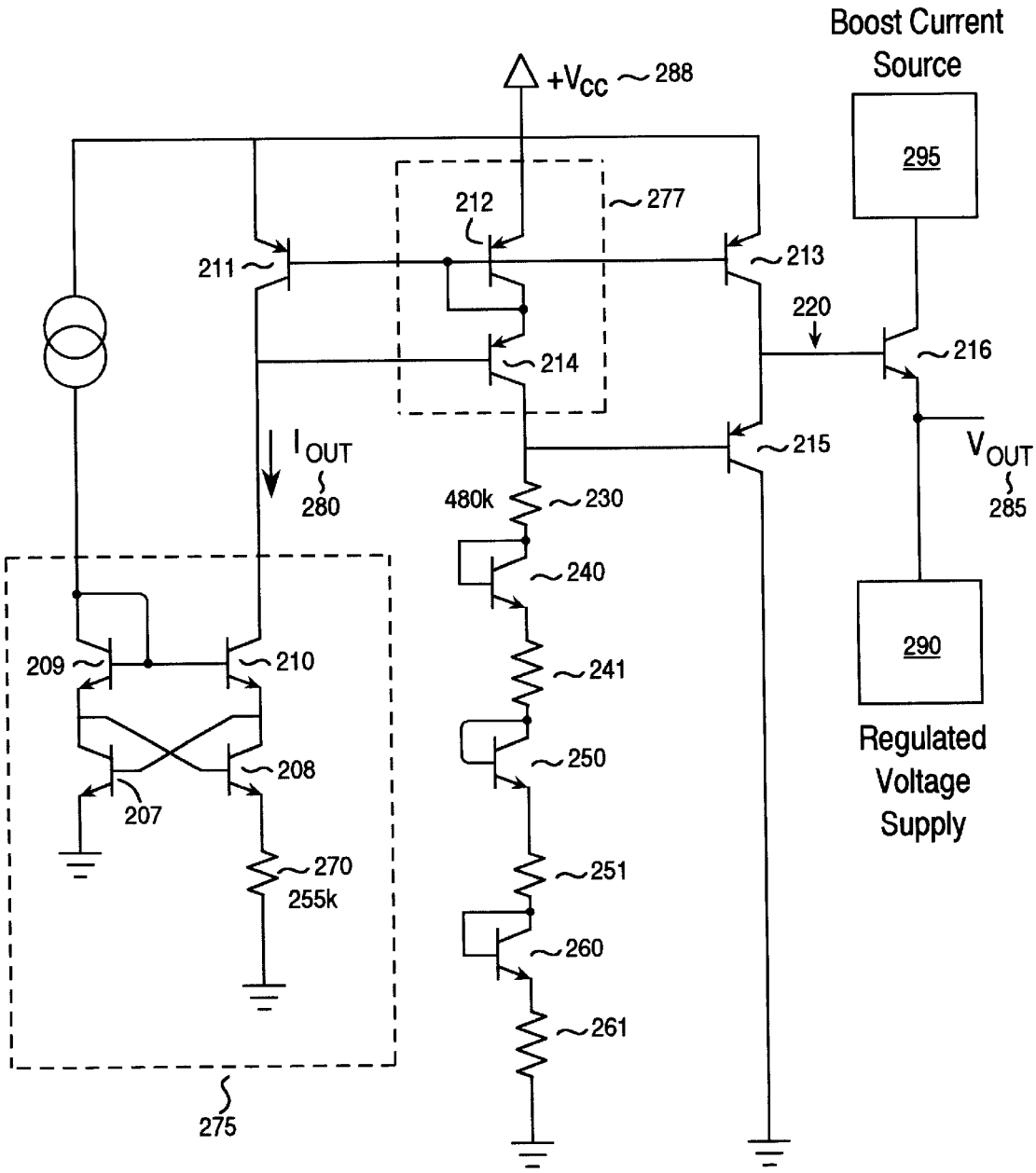
FIG. 2 illustrates a low current open loop voltage regulator monitor, according to an embodiment of the present invention.

FIG. 2 illustrates a low current open loop voltage regulator monitor, according to an embodiment of the present invention. It is to be appreciated that embodiments of the present invention generally are used in conjunction with other circuitry, for example a regulated voltage supply, to form a more capable power supply. Voltage Vout 285 is a desired regulated voltage produced by regulated voltage supply 290. Regulated voltage supply 290 is typically used to provide electrical power at a constant voltage to a variety of other devices, for example electronic circuits or devices, not shown. In this exemplary embodiment, Vout 285 is desired to be 5 volts. Voltage Vcc 288 may range from approximately just greater than 5 volts to approximately 60 volts. In general, voltage Vcc 288 should be at least about 200 mV higher than voltage Vcc 285. Boost current source 295, coupled to the collector of transistor device 216 is designed to provide a high capacity current source.

Circuit 275 is a current source with an output that is Proportional To Absolute Temperature (PTAT). U.S. Pat. No. 3,930,172 entitled "Input Supply Independent Circuit" to Dobkin more fully describes this circuit arrangement, and is hereby incorporated herein by reference in its entirety. The characteristics of this circuit are highly desirable in a power supply. However, it is to be appreciated that other current source designs are well suited to embodiments of the present invention.

Through the selection of transistor devices 207, 208, 209 and 210, and resistor 270 which is approximately 255 k ohms, circuit 275 may be designed to produce current Iout 280 of approximately 420 nA. Due to the characteristics of circuit 275, current Iout 280 will be relatively stable with respect to temperature.

Current Iout 280 is mirrored by transistor devices 211, 212, 213 and 214. Transistor devices 212 and 214 form a cascode 277, producing a current source with a very high output impedance. Transistor device 213 forms a higher voltage current source with a much lower output impedance. Transistor device 213 drives the emitter of transistor device 215.

If the current on the collector of transistor device 213 doubles, the voltage on the emitter of transistor device 215 will increase by about 18 mV (at 27 degrees C.). The current from the collector of transistor device 214 will drop through several diode and resistor devices, resistors 230, 241, 251 and 261 and diodes 240, 250 and 260 and 215. Since Iout is proportional to absolute temperature, the voltage drops across resistors 230, 241, 251 and 261 will also be proportional to absolute temperature. These proportional to absolute temperature voltages may be matched with the drops across diodes 240, 250 and 260 and 215 to form separate bandgap voltages that sum to the output voltage.

For example, the voltage across diode 260 and resistor 261 is approximately 1.25 volts. These devices form a bandgap. Similarly, the drop across diode 250 and resistor 251 is about 1.25 volts. Likewise, the drop across diode 240 and resistor 241 is approximately 1.25 volts. With the proper choice of resistor 230, in this example approximately 480 k ohms, the combination of transistor device 251 and resistor 230 also produces a bandgap voltage drop of approximately 1.25 volts. Consequently, the four bandgap voltages total approximately 5 volts, which is the desired supply voltage. In additional embodiments of the present invention, bandgap voltages may be added, removed or stacked in other combinations to form temperature stable references for other desired operating voltages.

As a result, point 220, the base of transistor device 216, is held at approximately 5 volts. As previously described, the emitter of transistor device 216 is coupled to the output of regulated voltage source 290 that attempts to maintain Vout 285 at 5 volts. When regulated voltage source 290 is within tolerance, there is typically no, or a very small voltage $V_{BE}$ across the base-emitter junction of transistor device 216. With $V_{BE}$ less than about 300 mV, transistor device 216 will be in an "off" state, and will conduct essentially no current.

If Vout 285 should drop below about 4.7 volts (5 V minus 300 mV), for example due to application of a sudden additional load, transistor device 216 will begin to turn on, conducting current from boost current source 295 to provide a high capacity current source attached to the collector of transistor device 216. Additional current from boost current source 295 is added to Vout to help maintain Vout at a desired level. In this novel manner, a regulated voltage supply may be independently monitored, and a supercharge or boost current source may be switched in to support the voltage supply under high load situations, providing faster and better response to load variations than is characteristic for regulated supplies under the prior art.

The preferred embodiment of the present invention, a low current open loop voltage regulator monitor, is thus described. While the present invention has been described in particular embodiments, it should be appreciated that the present invention should not be construed as limited by such embodiments, but rather construed according to the below claims.

What is claimed is:

1. An integrated circuit low current open loop voltage regulator monitor circuit comprising:

a first current source;

a current mirroring circuit coupled to said first current source;

a second current source coupled to said current mirroring circuit;

a third current source coupled to said current mirroring circuit;

a voltage reference coupled to the output of said third current source to bias said output to a desired voltage; and a voltage comparing switch coupled to said output of said third current source and coupled to a regulated voltage supply, said voltage comparing switch for conducting a current onto said regulated voltage supply.

2. The circuit as described in claim 1 further comprising a boost current source coupled to said voltage comparing switch for supplying a current conducted onto said regulated voltage supply.

3. The circuit as described in claim 1 wherein said first current source is proportional to absolute temperature.

4. The circuit as described in claim 1 wherein said second current source has a high output impedance.

5. The circuit as described in claim 4 wherein said second current source is a cascode configuration of a plurality of transistors.

6. The circuit as described in claim 1 wherein said third current source has an output impedance at least one transistor beta ratio smaller than said second current source.

7. The circuit as described in claim 1 wherein said voltage reference is comprised of a plurality of bandgap voltages.

8. The circuit as described in claim 1 wherein said voltage comparing switch is a transistor device.

9. An integrated circuit low current open loop voltage regulator monitor circuit comprising:

a first transistor having a first region coupled to a boost current source, a second region coupled to a regulated voltage supply and a third region coupled to a voltage reference;

a second transistor having a first region coupled to said first transistor and a second region coupled to a plurality of resistors and diodes;

a cascode arrangement comprising a diode having a first region coupled to a power source and a second region coupled to a third transistor;

said third transistor having a first region coupled to said plurality of resistors and diodes and a second region coupled to a current source.

10. The voltage regulator monitor circuit as described in claim 9 wherein said current source is proportional to absolute temperature.

11. The voltage regulator monitor circuit as described in claim 9 further comprising a fourth transistor having a first region coupled to said second transistor and a second region coupled to said power source.

12. The voltage regulator monitor circuit as described in claim 9 further comprising a fifth transistor having a first region coupled to said power source and a second region coupled to said current source.

13. The voltage regulator monitor circuit as described in claim 9 wherein a reference current of said current source is comprised of a current from said second region of said third transistor and said second region of said fifth transistor.

14. The voltage regulator monitor circuit as described in claim 9 wherein said first transistor reacts to a voltage difference between said third region and said second region to conduct a current applied to said first region to said third region.

* * * * *